US006761643B2

(12) United States Patent
Boatwright

(10) Patent No.: US 6,761,643 B2
(45) Date of Patent: Jul. 13, 2004

(54) TRAINING DEVICE FOR TEACHING POCKET BILLIARDS

(76) Inventor: John Wayne Boatwright, 128 Timberlake Dr., Florence, SC (US) 29501-9309

( * ) Notice: Subject to any disclaimer, the term of this patent is extended or adjusted under 35 U.S.C. 154(b) by 32 days.

(21) Appl. No.: 10/141,732

(22) Filed: May 9, 2002

(65) Prior Publication Data

US 2003/0216188 A1 Nov. 20, 2003

(51) Int. Cl.[7] ..... A63D 15/00
(52) U.S. Cl. ..... 473/2; 273/108.21
(58) Field of Search ..... 473/1, 2, 4, 5, 473/14, 10, FOR 1, FOR 2, FOR 4, FOR 5, FOR 14, FOR 10; D21/782

(56) References Cited

U.S. PATENT DOCUMENTS

| | | | | | |
|---|---|---|---|---|---|
| 1,566,057 | A | * | 12/1925 | Wilkinson | 273/108.21 |
| 1,708,318 | A | * | 4/1929 | Little | 273/309 |
| 1,845,531 | A | * | 2/1932 | Terry | 473/159 |
| D162,404 | S | | 3/1951 | Gregory | |
| 3,410,555 | A | * | 11/1968 | Murch | 473/2 |
| 3,704,887 | A | | 12/1972 | Thorton | |
| 3,743,288 | A | | 7/1973 | Danklefsen | |
| 3,949,987 | A | * | 4/1976 | Candor | 473/407 |
| 3,989,244 | A | * | 11/1976 | Wadina | 473/2 |
| 4,063,728 | A | | 12/1977 | Zemanek | |
| 4,120,494 | A | | 10/1978 | Roe | |
| 4,183,523 | A | | 1/1980 | Hecht | |
| 4,251,072 | A | * | 2/1981 | Anthony | 473/18 |
| 4,882,676 | A | * | 11/1989 | Van De Kop et al. | 473/2 |
| 5,116,048 | A | * | 5/1992 | Bilocerkowycz et al. | 273/108.21 |
| 5,154,415 | A | * | 10/1992 | Zotos | 473/2 |
| 5,183,254 | A | | 2/1993 | Jones | |
| 5,716,283 | A | * | 2/1998 | Simpson et al. | 473/2 |
| D418,356 | S | | 1/2000 | Davis | |
| 6,053,817 | A | | 4/2000 | Fiegel | |

OTHER PUBLICATIONS

Muller Recreatonal Products—pp. 94 and 95—2002 wholesale catalog.*

* cited by examiner

*Primary Examiner*—Stephen P. Garbe
*Assistant Examiner*—Mitra Aryanpour
(74) *Attorney, Agent, or Firm*—McNair Law Firm, P.A.

(57) ABSTRACT

A training device for teaching pocket billiards comprises an overlay placed on a playing surface of a pool table having indicia representing a plurality of predetermined shots. Indicia for each of the shots including a cue ball marker and an object ball marker for indicated placement of a cue ball and an object ball, and a cue ball return area to which the cue ball returns after impact with the object ball. Indicia includes a first trajectory line extending between the cue ball marker and the object ball marker, and a second trajectory line extending from the object ball marker in the direction of one of the pockets. An associated guide manual is provided containing English instructions for imparting spin to the cue ball according to the shot. The indicia for each of the predetermined shots are a different color so that the player can easily differentiate between shots.

18 Claims, 2 Drawing Sheets

TRAINING DEVICE FOR TEACHING POCKET BILLIARDS

FIELD OF THE INVENTION

The present invention relates to training devices for teaching pocket billiards, and more particularly, to a felt overly for covering the playing surface of a pool table that includes a plurality of color-coded indicia representing a series of various prescribed billiard shots, and an associated guide manual including instructions for imparting English to the cue ball for each of the various prescribed shots.

BACKGROUND OF THE INVENTION

Pocket billiards, a game commonly referred to as pool, requires a combination of skill and knowledge to effectively strike a cue ball with a cue stick to direct a plurality of object balls into pockets located around the edges of the playing surface. One of the more important and difficult aspects of the game is the use of "English" to impart spin to the cue ball to affect its trajectory, as well as the trajectory of the object ball. Primarily, English is a technique used by skilled players to control the cue ball after impact with an object ball to align the cue ball for the next shot. Additionally, English is also used by skilled players to provide for a strategic placement of the cue ball to make an opponents next shot more difficult, to prevent the cue ball from rolling into one of the pockets, commonly called a scratch, and imparting spin to an object ball. For purposes of this application, any spin that may be applied to the cue ball will be referred to as English.

One of the problems for a novice billiards player is knowing what type and how much English to impart to the cue ball for a given shot to properly position the cue ball at a desired location after impact with the object ball. In order to effectively impart English to a cue ball, it is important for the player to understand how the cue ball will react in a variety situational shot types.

Helping to increase the player's skill, numerous training and learning devices have been developed to improve the players knowledge of the interaction between the cue ball and the object ball. However, these prior teaching devices do not provide any device that teaches a comprehensive use of English in a variety of shot types to help a player improve his knowledge and skill in controlling the cue ball.

For example, U.S. Pat. No. 3,704,887 discloses a guide utilizing spots and rings drawn on a playing surface for teaching specific angle shot aiming techniques. This device does not provide any training for the use of English in properly setting up and making pool shots and fails to provide other needed training procedures for teaching a variety of different type pool shots as would be found in an actual game.

Also, U.S. Pat. No. 4,120,494 discloses a training device comprising a planar material placed on the playing surface of a pool table having a set of prearranged indicia for teaching different angle shots. Again, however, this device is limited to teaching only angle shots and does not provide a method for teaching how to make other shots such as carom shots and bank shots, commonly used by those skilled in the game. While the invention does disclose some indicia on the playing surface for imparting English to the cue ball, it is limited to left and right English and does not disclose how to impart other types of spin to the cue ball for a variety of shot types, or for using English to set up subsequent shots. Furthermore, there is no distinction between the various indicia to avoid confusion between predetermined shots represented by the indicia.

Additionally, U.S. Pat. No. 6,053,817 discloses a carom guide for pocket billiards designed to be positioned at various locations on the playing surface of the pool table to provide indicia for making a plurality of specific carom shots only. As with the other devices in the prior art, this device fails to provide indicia for performing a plurality of different situational shot types as would be encountered in an actual game of pool, and fails to provide any training for the use of English in making and setting up different shot types.

In the game of pocket billiards, it is of the highest importance to leave the cue ball in a good position after a shot to allow the player to have a proper line for the next shot. As noted, the method used by those skilled in the game to accomplish a proper placement of the cue ball is the use of English to impart spin to the cue ball. The prior art fails to provide appropriate training for imparting English to a cue ball for a variety of different shot types, as a player would find during a regular game of pool.

Accordingly, it is an object of the present invention to provide a training device for teaching a player how to use English on a cue ball for a variety of different shot types to both make shots and setup the cue ball for other shots.

It is an object of the present invention to provide a training device for teaching a player how to repeatedly perform a variety of different shot types that would commonly be found during a game of billiards.

SUMMARY OF THE INVENTION

The above objectives are accomplished according to the present invention by providing a training device for teaching a player pocket billiards on a pool table. The training device comprises an overlay for placement on the playing surface of a pool table, where the playing surface is bordered by railings with cushions adjacent the playing surface and four corner pockets and two side pockets.

In the preferred embodiment, indicia are displayed on the overlay representing a plurality of various prescribed shots, including carom shots, rail bank shots, and angle shots commonly encountered during a game of billiards. Preferably, a cue ball marker and an object ball marker are included in the indicia for each of the various prescribed shots for indicating the placement position of a cue ball and an object ball on the overlay. A first trajectory line is included in the indicia for each of the shots extending between the cue ball marker and the object ball marker. A second trajectory line is also included in the indicia extending from the object ball marker in the direction of one of the pockets for illustrating a prescribed travel path for the cue ball and the object ball.

In the preferred embodiment, the training device includes an associated guide manual containing English instructions for enabling the player to impart spin to the cue ball specific to individual ones of the various prescribed shots.

In a further advantageous embodiment, the training device includes a cue ball return area included in the indicia on the overlay that designates an area in which the cue ball is to return after impact with the object ball. Preferably, the cue ball return area is located on the overlay to generally correspond to a central area of the playing surface of the pool table. Preferably, the associated guide manual for the training device contains instructions for enabling the player to impart a requisite amount English to the cue ball for each of the various prescribed shots to cause the cue ball to return to the cue ball return area at the end of each shot when executed correctly.

In a further advantageous embodiment, the training device indicia for each of the prescribed shots are a different color so that the player can easily differentiate between the plurality of shots displayed on the overlay. Additionally, the cue ball marker and object ball marker for each of the shots can be a different color so that the player can easily differentiate between the ball markers for the plurality of shots displayed on the overlay. Also, the first and second trajectory lines for each of the prescribed shots can be a different color so that the player can easily differentiate between the trajectory lines for the plurality of shots displayed on the overlay.

In a further advantageous embodiment, the training device includes a carom ball marker included in the indicia in a number of the prescribed shots. Additionally, the overlay includes an interference ball marker in the indicia in a number of the prescribed shots to allow the player to practice a variety of different shot types that would regularly be encountered in a game of pool.

Advantageously, the overlay includes a fastening member for affixing at least one corner of the overlay to one of the pockets of the pool table. It is also advantageous to provide an overlay that covers the entire playing surface of the pool table so that there are no rough edges for the billiard balls to roll over.

As a result, a training device is provided for teaching the player how to use English on a cue ball for a variety of different shot types to both make shots and setup the cue ball for other shots.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
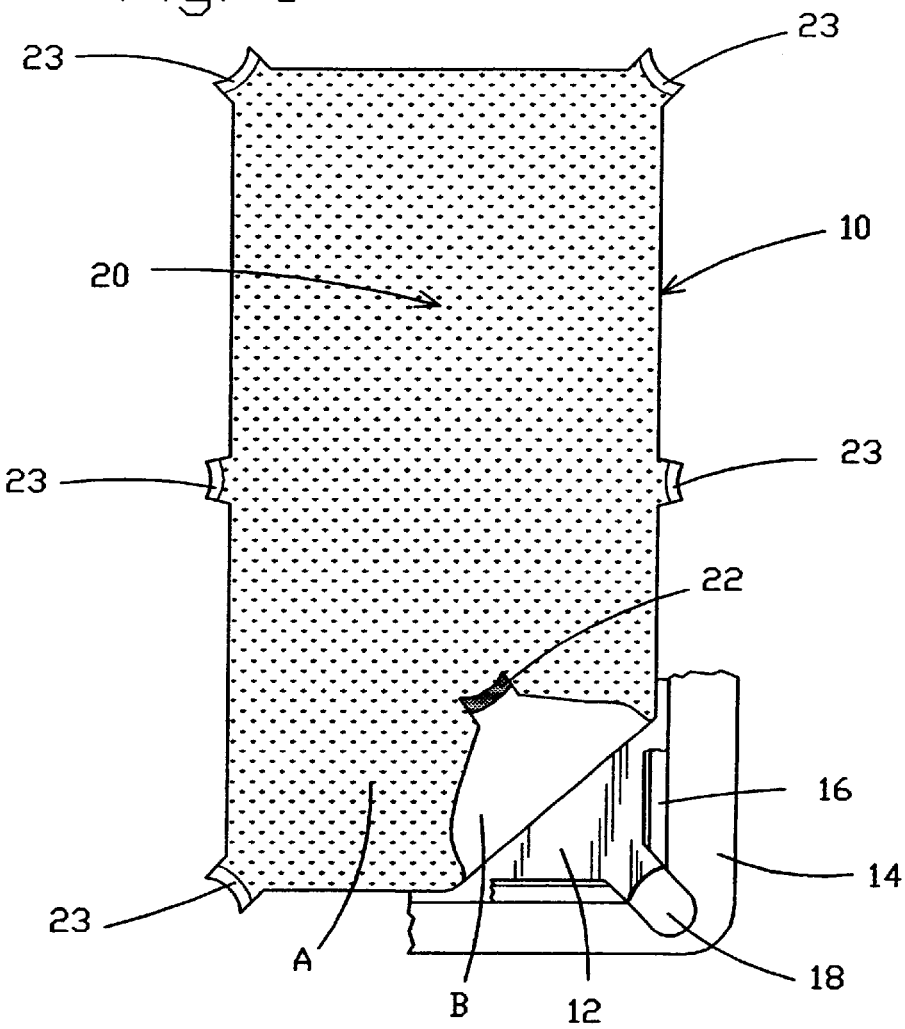
FIG. 1 shows a top view of the overlay according to the invention.

Referring now to the drawings, the invention will be described in more detail. As shown in FIG. 1, the training device comprises an overlay 10, which is placed on the playing surface 12 of a pool table. The playing surface of the pool table is bordered by a railing 14 having cushions 16 along the inner edge of the railing adjacent to the playing surface. The pool table also includes four corner pockets 18, as well as two side pockets 19, shown in FIG. 3.

Commonly, playing surface 12 of the pool table is made from a slab of slate covered in a felt type cloth material that allows billiard balls to roll smoothly, while still maintaining sufficient friction for the billiard balls to grip the cloth material when English is applied to a shot. Overlay 10 is preferably made from the same felt type material typically used to cover the playing surface and is placed directly on playing surface 12 to cover the entire playing surface of the pool table. However, overlay 10 is not limited to such a cloth material and can be made of any material suitable to displaying indicia and on which billiard balls will roll smoothly. Preferably, overlay 10 is a removable overlay that may be temporarily placed overtop of the standard felt playing surface while the player uses the training device to practice specific billiard shots.

Referring to FIG. 1, overlay 10 includes an upper surface, designated generally as A, and a bottom surface, designated generally as B. Indicia, designated generally as 20, are displayed on upper surface A of overlay 10 to provide a plurality of various prescribed shots, shown generally by overlay10 in FIG. 3, that the player can use to practice a specific type of shot repeatedly, or work through a series of different shots to develop a better overall understanding of the game. Overlay 10 includes pocket extensions 23 located at the four corners of the overlay as well as two sides of the overlay, which correspond to the location of pockets on the pool table. These pocket extensions fold down into the pockets to help affix the overlay on the playing surface. Additionally, a fastening member 22 is affixed to bottom surface B of the pocket extension to attach the overlay to the inner surface of the pockets below the playing surface. Preferably, fastening member 22 is a hook and loop connector with one portion of the hook and loop connector attached to bottom surface B of pocket extension 23 and the other portion of the connector attached to the inner surface of the pocket. In the preferred embodiment, at least one fastening member is provided at a corner pocket extension for affixing the overlay to the pool table, however, it is advantageous to provide a fastening member on the bottom surface of each of the pocket extensions in order to further secure the overlay to the pool table and prevent the overlay from shifting or lifting up during use.

Figure 3:
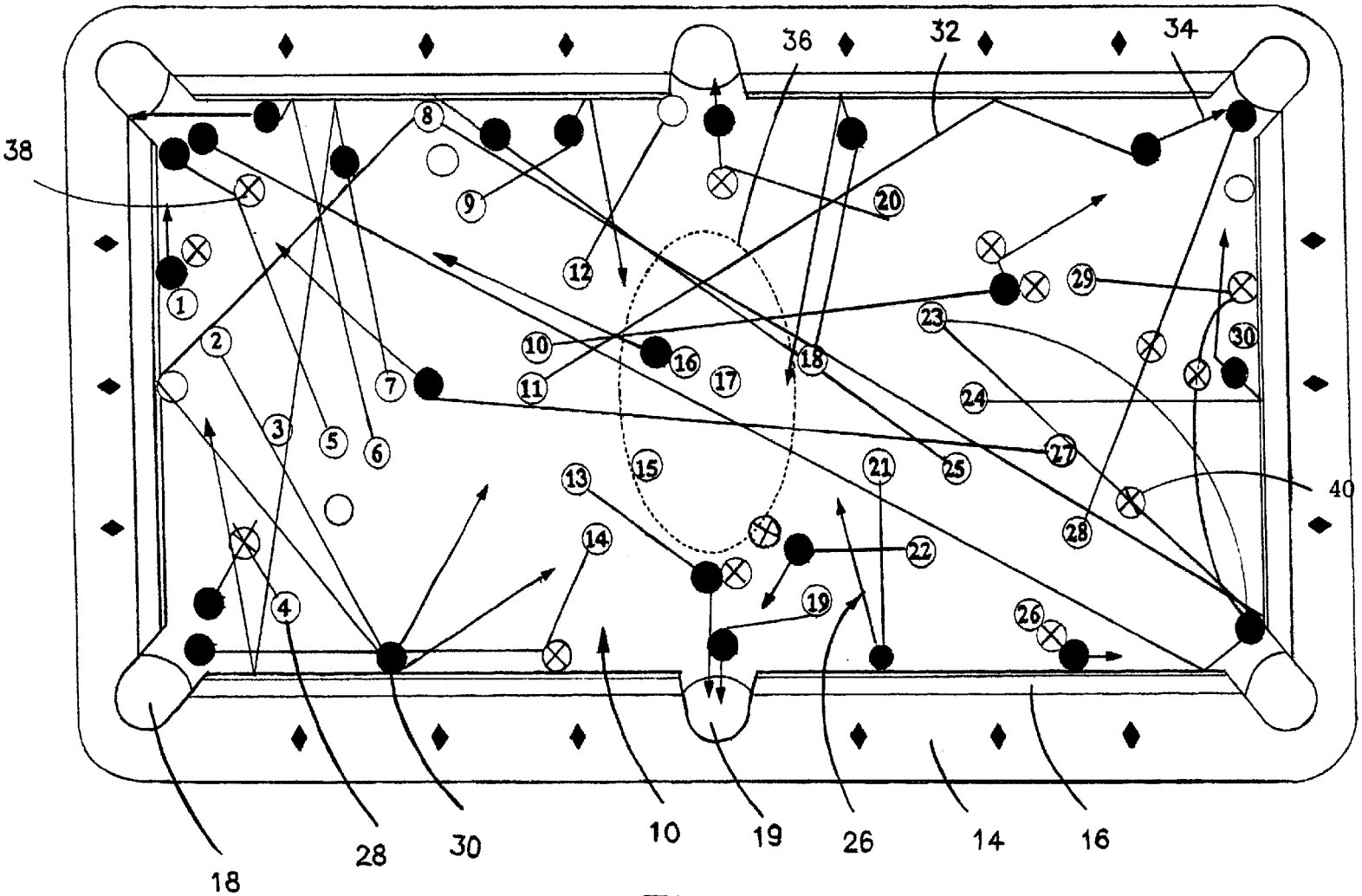

Referring to FIG. 3, a prescribed shot, designated generally as 26, is shown among a plurality of different prescribed shots displayed on overlay 10. Each prescribed shot includes a cue ball marker 28 and an object ball marker 30 for indicating the placement position of a cue ball and an object ball on overlay 10. In order to assist the player in correctly performing the shot, a first trajectory line 32 is included in the indicia for each of the prescribed shots which extends between the cue ball marker and the object ball marker. This illustrates to the player the proper line of travel the cue ball should have if that particular prescribed shot is performed correctly. Additionally, a second trajectory line 34 is included in the indicia for each of the prescribed shots that extends from the object ball marker in the direction of one of the corner or side pockets to complete the shot. When taken together as a whole, the ball placement markers and trajectory lines provides a complete shot showing the appropriate line of travel for both the cue ball and the object ball when the shot is correctly performed.

As shown in FIG. 3, in the preferred embodiment, the indicia displayed on overlay 10 also includes a carom ball marker 38 in a number of selected prescribed shots for teaching the player how to execute carom type shots often encountered during a game of pool. In a further advantageous embodiment, the indicia displayed on overlay 10 also includes an interference ball marker 40 in a number of selected prescribed shots. The introduction of the carom ball marker and interference ball marker provide a more comprehensive set of prescribed shots. This allows the player to practice a variety of different shot types that are commonly found during an actual game of pool and help the player better understand the interaction between a cue ball and object ball in different situations, further contributing the players skill at the game.

Figure 2:
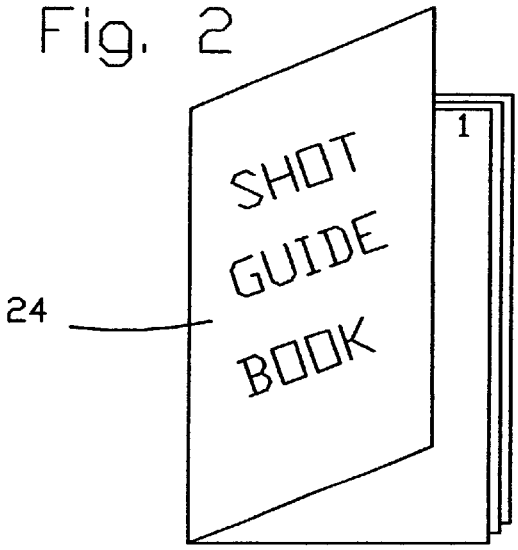
FIG. 2 shows a guide manual associated with the overlay according to the invention; and, FIG. 3 shows a top view of the overlay placed on the playing surface of a billiard table according to the invention.

Referring to FIG. 2, the training device includes an associated guide manual 24 that is intended to be used in conjunction with overlay 10 that contains English instructions for enabling the player to impart a requisite amount of spin to the cue ball specific to individual ones of the various prescribed shots. As shown in FIG. 3, a circled number from 1 to 30 represents each cue ball marker, while the solid shaded circles represent object ball markers and the x-out circles represent carom ball markers and interference ball markers. Each numbered circle representing the starting cue ball placement on overlay 10 for a different prescribed shot. Each of the numbered cue ball position markers has a corresponding instruction set in guide manual 24, which provides instructions on how to properly strike the cue ball with a cue stick to correctly perform the selected prescribed shot. As shown in TABLE ONE, each of shots 1 through 30, depicted on overlay 10, has a corresponding instruction in the guide manual with a depiction of the cue ball. The cue ball depiction shows where a cue stick should strike the cue ball in order to apply appropriate English for the selected prescribed shot. Preferably, the player will perform each of the prescribed shots in sequence from 1 to 30. As the player works through each of the shots they are exposed to a different type of shot with various levels of difficulty. Preferably, the difficulty increases as the player works his way through each shot. Together, the overlay and associated guide manual provide a comprehensive training device for teaching a player how to perform a variety of different shots, as well as how to use a requisite amount of English to correctly performing each of those shots. This helps the player understand how much English a shot may require to better position the ball for a next shot, prevent a scratch or some other strategic placement of the cue ball.

In order to further train the player in the appropriate use of English for a plurality of different shots, the indicia on overlay 10 includes a cue ball return area 36 that designates an area in which the cue ball is to return after impact with an object ball. In the preferred embodiment, the cue ball return area is located on upper surface A of overlay 10 to generally correspond to a central area of the playing surface of the pool table. However, cue ball return area 36 can be placed anywhere on the overlay to teach control over the cue ball. Also, a plurality of cue ball return areas may be provided for teaching the player to selectively position the cue ball around the playing surface at the end of each of the prescribed shots. In a further advantageous embodiment, guide manual 24 contains instructions for enabling the player to impart English to the cue ball for each of the prescribed shots to cause the cue ball to return to the cue ball return area at the end of each shot when executed correctly. This helps to teach the player how to set up the cue ball for a next shot as well as generally control the cue ball to selectively position the cue ball on the playing surface at the end of a shot.

In order to help the player differentiate between the various shots, each of prescribed shots 1 through 30, as depicted in FIG. 3, is preferably represented by a different color. For example, in shot number 21 the cue ball marker, object ball marker, first trajectory line, and second trajectory line would all be red in color, which would be the only red indicia on upper surface A of overlay 10. Alternatively, overlay 10 can be provided with different colors for each of the cue ball markers and object ball markers in order to differentiate between the prescribed shots. Further, the prescribed shots could also be differentiated by making the first and second trajectory lines for each prescribed shot a different color. Ultimately, the result is to provide a color-coded distinction between each of the prescribed shots such that the player can easily differentiate between ball position markers for the various prescribed shots.

Although the invention is intended as a training device, the overlay can also be used as a game, such as to conduct a pool tournament. When utilized as a game, a player would attempt each of the prescribed shots in a specified order, preferably sequentially. Points would be awarded for successfully completing each prescribed shot in order. Additional points may be awarded for causing the cue ball to stop in cue ball return area 36. Points may be deducted for scratches. The player with the highest point total would win the game or tournament. These rules are for illustrative purposes only and not intended to be the only type of game that can be played with the overlay.

While a preferred embodiment of the invention has been described using specific terms, such description is for illustrative purposes only, and it is to be understood that changes and variations may be made without departing from the spirit or scope of the following claims.

TABLE ONE

| INDIVIDUAL SHOT INSTRUCTIONS |
|---|
| 1. FROZEN COMBINATION SHOT: |
| Shoot Object Ball In Center. (No English) |
| 2. ONE RAIL BANK SHOT: |
| Bank Shots Are A Must In A Pool Game. Practice This Shot To Train Your Eye. (No English) (If You Do Not Have A Dead Bank Shot, Experiment With English To Change The Object Ball Line. |
| 3. COMBINATION FROZEN SHOT: |
| Object Ball And Secondary Are Frozen Together. Shoot Object Ball On Right Side. (Use Top English) |
| 4. CAROM DRAW SHOT: |
| This Is A Shot You Must Practice. Don't Get Frustrated. Draw Imaginary Lines From The Cue Ball And The Object Ball To The Secondary Ball. The Interception Point Is Your Target. (Use Bottom English) |
| 5. CAROM SHOT: |
| Easy Formula . . . Draw An Imaginary Line From Object Center To Secondary Ball. This Is Your Target. (No English) |
| 6. FROZEN RAIL SHOT: |
| Shoot Cue Ball Into Rail As Close As Possible To Object Ball. Cue Ball Will Rebound And Hit Object Ball. (Use Left English) |
| 7. DOUBLE BANK SHOT: |
| Practice Is Very Important. English Is Critical. This Shot Will Teach You The Use Of The Rail Diamonds. (Use Left English). |
| 8. TWO RAIL KICK SHOT: |
| This Shot Will Teach You To Move Around The Table And How To Make Shots When You Are Blocked. (Use Top Right English) |
| 9. CRISSCROSS SHOT: |
| Hit Approximately 1/8 Of Object Ball Across Face. Ball Will Cross Table To Desired Pocket. (No English) |

TABLE ONE-continued

| INDIVIDUAL SHOT INSTRUCTIONS |
|---|
| 10. DOUBLE COMBINATION SHOT: |
| Shoot Object Ball Slightly Off Center. (No English) |
| 11. CUSHION FIRST SHOT: |
| Shoot Using A Soft Stroke. (Right English) |
| 12. FROZEN CUSHION SHOT: |
| Object Ball Is Frozen Against Cushion. Shoot Ball Hard . . . Rail Will Compress Allowing Object Ball To Go Into Pocket. (Bottom Right English) |
| 13. KISS-OFF SHOT: |
| This Shot Will Teach You How To Pick Out A Shot From A Cluster Of Balls. (No English) |
| 14. FROZEN CAROM SHOT: |
| Hit 1/3 Of Secondary Ball. Cue Ball Will Veer Off And make Object Ball. Speed Is Critical. (Use Top English) |
| 15. ONE RAIL BANK SHOT: |
| Hit Object Ball In Center (No English) |
| 16. FROZEN OBJECT AND CUE BALL SHOT: |
| Shoot Cue Ball With A Medium Stroke And Good Follow Through: (Left English) |
| 17. KICK SHOT: |
| As Simple As The Name. This Shot Will Teach You Hand To Eye Coordination. (No English) |
| 18. CROSS BANK SHOT: |
| Hit Object Ball On Right Face. Ball Will Cross Bank And Go Into Side Pocket. (No English) |
| 19. CUT SHOT: |
| Shoot Cue Ball So As To Hit Right Face Of Object Ball. This Is An Important Shot To Learn. (No English Required) |
| 20. RIGHT ANGLE CAROM SHOT: |
| Draw Imaginary Lines From Cue Ball And Object Ball To Secondary Ball. The Intersection Is The Target Point. Speed Is Important. (Bottom Right English) |
| 21. FROZEN RAIL BANK SHOT: |
| Shoot The Cue Ball With Slow Speed. (Extreme Left English) |
| 22. COMBINATION SHOT: |
| Shoot Cue Ball Into Secondary Ball. Cue Ball Will Bounce Off And Hit Object Ball. (Bottom English) |

TABLE ONE-continued

| INDIVIDUAL SHOT INSTRUCTIONS |
|---|
| 23. CURVE-BALL SHOT: |
| Elevate Butt Of Cuestick To 45 Degrees. Shoot Down On The Cue Ball. The Cue Ball Will Curve Around The Interference Ball And Hit The Object Ball. Practice Is Important! Don't Get Discouraged. Speed Is Critical (Top Right English) |
| 24. RAIL KISS SHOT: |
| Shoot Into Rail As Close To Object Ball As Possible. Cue Ball Will Hit Object Ball And Knock It Into The Secondary Ball. The Object Ball Will Glance Off And Go Into The Desired Pocket. (Bottom Left English) |
| 25. THREE RAIL BANK SHOT: |
| This Shot Will Teach You The Use Of The Rail Dots As A Road Map. It Will Also Impress Your Opponents. (No English) |
| 26. FROZEN CUE BALL COMBINATION SHOT: |
| Stroke Is Important. Shoot Easily. (Bottom Right English) |
| 27. SPOT SHOT: |
| Place Object Ball On "Racking Spot". Place Cue Ball As Shown. Aim Through Object Ball To Center Dot On Opposite End. (No English) |
| 28. JUMP SHOT: |
| This Is A Legal Shot If Done Correctly. It Is Illegal To "Scoop The Ball" This Is A Foul Shot. You Must Strike The Cue Ball Above Center. Elevate The Butt Of Cue Stick To 45 Degrees. Strike Down Hardly On Cue Ball. One Tip Width Above Center. |
| 29. FROZEN CAROM SHOT: |
| Hit Right 1/3 Of Secondary Ball. Cue Ball Will Veer Off And Make Object Ball. Speed Is Critical. (Top English) |
| 30. FROZEN CUSHION SHOT: |
| Both Balls Are Frozen On Rail. Making The Shot Is Not The Problem, Getting The Cue Ball Off The Rail Is. (Bottom Left English). |

What is claimed is:

1. A training device for teaching a player pocket billiards on a pool table having a playing surface bordered by cushion railings with four corner pockets and two side pockets, said training device comprising:

an overlay for placement on the playing surface of the pool table;

indicia displayed on said overlay representing a plurality of various prescribed shots including carom shots, rail bank shots, and angle shots commonly encountered during a game of billiards;

a cue ball marker and an object ball marker included in said indicia for each of said various shots for indicating the placement position of a cue ball and an object ball on said overlay;

a first trajectory line included in said indicia for each of said various shots extending between the cue ball marker and the object ball marker, and a second trajectory line extending from the object ball marker in the direction of one of said pockets for illustrating a prescribed travel path for the cue ball and the object ball;

a cue ball return area included in said indicia on said overlay corresponding to a generally centralized area of the playing surface for designating an area in which the cue ball is to return after impact with the object ball; and, an associated guide manual containing instructions on the use of English specific to each of said various shots for instructing said player on imparting a required amount of spin to said cue ball by striking the cue ball with a requisite amount of force at a designated location on the cue ball in order to properly complete each of said various shots and cause said cue ball to return to said cue ball return area at the end of each shot when executed correctly by the player;

whereby a training device is provided for teaching the player how to use English on a cue ball for a variety of different shot types to both make shots and setup the cue ball for other shots.

2. The training device of claim 1 wherein said indicia for each one of said various prescribed shots is a different color from the indicia of every other shot so that the player can easily differentiate between the plurality of various shots displayed on said overlay.

3. The training device of claim 2 wherein said cue ball marker and object ball marker for each of said various prescribed shots are a different color so that the player can easily differentiate between the ball markers for the plurality of various shots displayed on said overlay.

4. The training device of claim 3 wherein said first and second trajectory lines for each of said various prescribed shots are a different color so that the player can easily differentiate between the trajectory lines for the plurality of various shots displayed on said overlay.

5. The training device of claim 1 including a carom ball marker included in said indicia in a number of said various prescribed shots.

6. The training device of claim 1 including an interference bail marker included in said indicia in a number of said various prescribed shots.

7. The training device of claim 1 wherein said overlay includes a fastening member for affixing a corner of said overlay to one of the pockets of the pool table.

8. The training device of claim 1 wherein said overlay covers the entire playing surface of the pool table.

9. A training device for teaching a player pocket billiards on a pool table having a playing surface bordered by cushion railings with four corner pockets and two side pockets, said training device comprising:

an overlay for covering the entire playing surface of the pool table;

indicia displayed on said overlay representing a plurality of various prescribed shots including carom shots, rail bank shots, and straight angle shots commonly encountered during a game of billiards;

said indicia including a cue ball return area designating a generally centralized area of the playing surface to which a cue ball is to be returned after hitting an object ball with a requisite amount of spin and momentum to cause said cue ball to proceed to the return area at the end of each shot; and an associated guide manual containing instructions for enabling said player to impart a requisite amount of English to said cue ball for each of said various prescribed shots to cause said cue ball to return to said cue ball return area at the end of each shot when executed correctly by the player;

whereby a training device is provided for teaching the player how to control a cue ball for a variety of different shot types to both make shots and setup the cue ball for other shots.

10. The training device of claim 9 wherein said indicia includes a cue ball marker and an object ball marker for each of said various prescribed shots for indicating the placement position of the cue ball and the object ball on said overlay.

11. The training device of claim 10 wherein said indicia includes a first trajectory line for each of said various prescribed shots extending between said cue ball marker and said object ball marker; and a second trajectory line extending from said object ball marker in the direction of one of said pockets for illustrating a prescribed travel path for the cue ball and the object ball.

12. The training device of claim 11 wherein said cue ball marker and object ball marker for each of said various prescribed shots are a different color so that the player can easily differentiate between the ball markers for the plurality of shots displayed on said overlay.

13. The training device of claim 12 wherein said first and second trajectory lines for each of said various prescribed shots are a different color so that the player can easily differentiate between the trajectory lines for the plurality of shots displayed on said overlay.

14. The training device of claim 9 wherein said overlay includes a fastening member for affixing a corner of said overlay to one of the pockets of the pool table.

15. A training device for teaching a player pocket billiards on a pool table having a playing surface bordered by cushion railings with four corner pockets and two side pockets, said training device comprising:

an overlay for placement on the playing surface of the pool table;

indicia displayed on said overlay for marking the location of billiard balls and illustrating a desired travel path for said billiard balls when hit;

said indicia representing a series of prescribed shots that the player performs in a designated order to complete a sequence of shots designed to train the player how to properly execute a variety of shots commonly encountered during a game of billiards;

said prescribed shots each representing a different type of shot with a different level of difficulty for testing the skill of the player in making the specified shot type; and, said level of difficulty for each of said prescribed shots is progressively more difficult as the player completes shots and moves sequentially through the shots;

whereby a comprehensive training device is provided for teaching the player how to repeatedly perform a variety of different shot types that would commonly be found during a game of billiards to increase the players understanding of the game.

16. The training device of claim 15 including an associated guide manual containing English instructions for enabling said player to impart a desired amount of spin to a cue ball specific to each of said various prescribed shots.

17. The training device of claim 16 including a cue ball return area designating an area of said overlay in which a cue ball is to be returned after hitting an object ball; said guide manual containing instructions for enabling said player to impart a requisite amount of spin for each of said prescribed shots to cause said cue ball to return to the cue ball return area at the end of each shot when executed correctly by the player.

18. The training device of claim 15 wherein said indicia for each of said prescribed shots is a different color so that the player can easily differentiate between the plurality of shots displayed on said overlay.

* * * * *